US008362978B2

(12) United States Patent
Park et al.

(10) Patent No.: US 8,362,978 B2
(45) Date of Patent: Jan. 29, 2013

(54) PLASMA DISPLAY AND METHOD OF RESETING THE DISPLAY

(75) Inventors: Suk-Jae Park, Yongin-si (KR); Woo-Joon Chung, Yongin-si (KR); Yeon-Sung Jung, Yongin-si (KR)

(73) Assignee: Samsung SDI Co., Ltd., Gyeonggi-Do (KR)

( * ) Notice: Subject to any disclaimer, the term of this patent is extended or adjusted under 35 U.S.C. 154(b) by 156 days.

(21) Appl. No.: 12/848,841

(22) Filed: Aug. 2, 2010

(65) Prior Publication Data

US 2011/0037749 A1 Feb. 17, 2011

(30) Foreign Application Priority Data

Aug. 11, 2009 (KR) ..... 10-2009-0073972

(51) Int. Cl.
*G09G 3/28* (2006.01)

(52) U.S. Cl. ..... 345/63

(58) Field of Classification Search ..... 345/204–215, 345/690–699, 204–215, 30–100
See application file for complete search history.

(56) References Cited

U.S. PATENT DOCUMENTS

| | | | | |
|---|---|---|---|---|
| 7,714,806 | B2 * | 5/2010 | Moon | 345/60 |
| 2005/0093853 | A1 * | 5/2005 | Kim | 345/210 |
| 2007/0085848 | A1 * | 4/2007 | Jeong et al. | 345/211 |
| 2009/0073091 | A1 * | 3/2009 | Park et al. | 345/60 |
| 2009/0091517 | A1 * | 4/2009 | Park et al. | 345/60 |
| 2009/0128537 | A1 | 5/2009 | Cho et al. | |
| 2009/0135100 | A1 * | 5/2009 | Kim et al. | 345/60 |
| 2010/0225671 | A1 * | 9/2010 | Makino et al. | 345/690 |
| 2010/0302224 | A1 | 12/2010 | Choi et al. | |

FOREIGN PATENT DOCUMENTS

| | | | |
|---|---|---|---|
| KR | 10-2005-013841 | A | 12/2005 |
| KR | 10-2005-0113837 | A | 12/2005 |
| KR | 10-0648708 | B1 | 11/2006 |
| KR | 10-0739595 | B1 | 7/2007 |
| KR | 10-2009-0032127 | A | 3/2009 |
| KR | 10-2009-0035196 | A | 4/2009 |
| KR | 10-2009-0050309 | A | 5/2009 |
| WO | WO 2008/132854 | A1 | 11/2008 |
| WO | WO 2009/044978 | A1 | 4/2009 |

OTHER PUBLICATIONS

Korean Notice of Allowance dated Dec. 13, 2010 for Korean Patent Application No. KR 10-2009-0073972 which corresponds to the captioned application.

Chinese Office Action dated Sep. 28, 2012 for Chinese Patent Application No. CN 201010251393.5 which shares priority of Korean Patent Application No. KR 10-2009-0073972 with captioned U.S. Appl. No. 12/848,841.

* cited by examiner

*Primary Examiner* — Kent Chang
*Assistant Examiner* — William Lu
(74) *Attorney, Agent, or Firm* — Knobbe Martens Olson & Bear LLP

(57) ABSTRACT

A plasma display is disclosed. The display includes driver circuitry which drives the display so that a low level luminance can be generated in a subfield despite high luminance efficient pixels.

9 Claims, 2 Drawing Sheets

PLASMA DISPLAY AND METHOD OF RESETING THE DISPLAY

CROSS-REFERENCE TO RELATED APPLICATIONS

This application claims priority to and the benefit of Korean Patent Application No. 10-2009-0073972 filed in the Korean Intellectual Property Office on Aug. 11, 2009, the entire contents of which are incorporated herein by reference.

BACKGROUND

1. Field

The field relates generally to a plasma display device and a driving method thereof.

2. Description of the Related Technology

A plasma display device is a display device with a plasma display panel (PDP) for displaying characters or images with plasma generated according to gas discharge.

The plasma display device drives by dividing a frame into a plurality of subfields each having a luminance weight value, and displays a grayscale by a combination of the weight values during display operations for the plurality of subfields. During a reset period of each subfield, a discharge cell is initialized by a reset discharge.

During an address period of each subfield, a scan pulse is sequentially applied to a plurality of scan electrodes, and an address pulse is selectively applied to a plurality of address electrodes when the scan pulse is applied to each scan electrode so that a light emitting cell or a non-light emitting cell is selected. An address discharge occurs in cells driven with the scan pulse and the address pulse.

During a sustain period of each subfield, the light emitting cell is sustain discharged so that images are displayed.

The plasma display device expresses a low unit light in the subfield which represents a minimum grayscale (for example, a grayscale of 1) in order to favor expression of low grayscales.

Generally, the unit light is expressed by applying one sustain pulse to the light emitting cell. However, when light efficiency of the plasma display panel (PDP) is increased, the luminance of the unit light is increased, and expression performance of low grayscales is decreased.

The above information disclosed in this Background section is only for enhancement of understanding of the background of the described technology and therefore it may contain information that does not form the prior art that is already known in this country to a person of ordinary skill in the art.

SUMMARY OF CERTAIN INVENTIVE ASPECTS

One aspect is a method of driving a plasma display where each frame includes a plurality of subfields having luminance weight values. The plasma display includes a first electrode and a second electrode extending in one direction. The method includes decreasing a voltage at the second electrode from a second voltage to a third voltage while a first voltage is applied to the first electrode during a first portion of a first subfield, where the first subfield has a minimum weight value as compared to the weight values of the other subfields. The method also includes applying a first scan pulse to the second electrode while the first voltage is applied to the first electrode during a first address period of the first subfield, changing the voltage at the first electrode from the first voltage to a fourth voltage, the fourth voltage being less than the first voltage, and increasing the voltage at the second electrode from a fifth voltage to a sixth voltage while the fourth voltage is applied to the first electrode during a first sustain period of the first subfield. The method also includes increasing the voltage at the second electrode from an eighth voltage to a ninth voltage, the ninth voltage being greater than the sixth voltage while a seventh voltage is applied to the first electrode during a reset period of a second subfield, and decreasing the voltage at the second electrode from an eleventh voltage to a twelfth voltage while a tenth voltage is applied to the first electrode during the reset period, where a difference between the first voltage and the third voltage is greater than a difference between the tenth voltage and the twelfth voltage.

Another aspect is a plasma display. The display includes a first electrode, a second electrode extending in the same direction as the first electrode, and a driver. The driver is configured to decrease a voltage at the second electrode from a second voltage to a third voltage while a first voltage is applied to the first electrode during a first portion of a first subfield, the first subfield having a minimum weight value as compared to the weight values of the other subfields. The driver is also configured to apply a first scan pulse to the second electrode while the first voltage is applied to the first electrode during a first address period of the first subfield, and change the voltage at the first electrode from the first voltage to a fourth voltage, the fourth voltage being less than the first voltage. The driver is also configured to increase the voltage at the second electrode from a fifth voltage to a sixth voltage while the fourth voltage is applied to the first electrode during a first sustain period of the first subfield, increase the voltage at the second electrode from an eighth voltage to a ninth voltage, the ninth voltage being greater than the sixth voltage while a seventh voltage is applied to the first electrode during a reset period of a second subfield, and decrease the voltage at the second electrode from an eleventh voltage to a twelfth voltage while a tenth voltage is applied to the first electrode during the reset period, where the difference between the first voltage and the third voltage is greater than the difference between the tenth voltage and the twelfth voltage.

DETAILED DESCRIPTION OF CERTAIN INVENTIVE EMBODIMENTS

Figure 1:
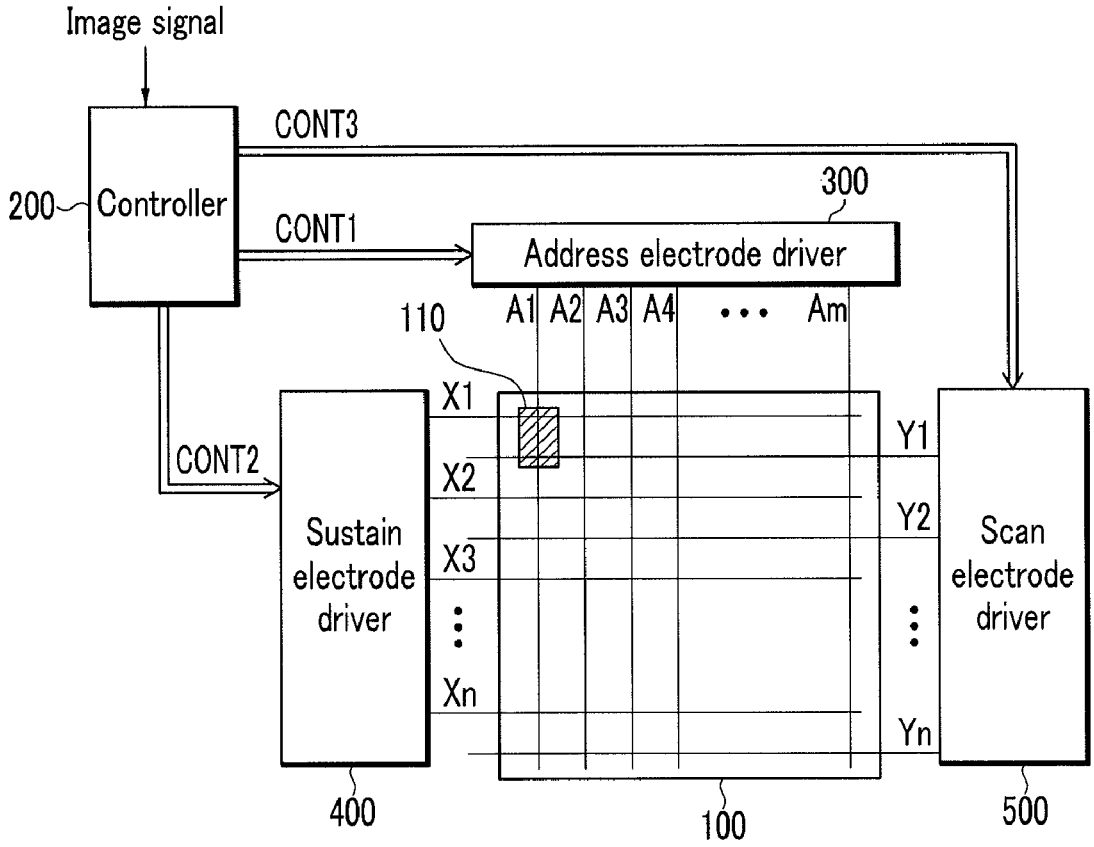
FIG. 1 is a drawing illustrating a plasma display device according to an exemplary embodiment.

In the following detailed description, certain exemplary embodiments have been shown and described, simply by way of illustration. As those skilled in the art would realize, the described embodiments may be modified in various ways, without departing from the spirit or scope of the present invention.

Accordingly, the drawings and description are to be regarded as illustrative in nature and not restrictive. Like reference numerals generally designate like elements throughout the specification.

Throughout the specification, if something is described to include constituent elements, it may further include other constituent elements unless it is described that it does not include the other constituent elements.

Wall charges indicate charges formed on a wall of discharge cells neighboring each electrode and accumulated to the electrodes. Although the wall charges do not actually touch the electrodes, it will be described that the wall charges are "generated," "formed," or "accumulated" thereon. Also, a wall voltage represents a potential difference formed on the wall of the discharge cells by the wall charges.

A plasma display device and a driving method thereof according to the exemplary embodiment will now be described in detail.

FIG. 1 is a drawing illustrating a plasma display according to an exemplary embodiment.

As shown in FIG. 1, the plasma display device includes a plasma display panel 100, a controller 200, an address electrode driver 300, a sustain electrode driver 400, and a scan electrode driver 500.

The plasma display panel 100 includes a plurality of address electrodes A1-Am (referred to as "A electrodes" hereinafter) extending in a column direction, and a plurality of sustain electrodes X1-Xn (referred to as "X electrodes" hereinafter) and a plurality of scan electrodes Y1-Yn (referred to as "Y electrodes" hereinafter) extending in a row direction, in pairs.

In general, the X electrodes X1-Xn are formed to correspond to the respective Y electrodes Y1-Yn, and the X electrodes X1-Xn and the Y electrodes Y1-Yn perform a display operation during a sustain period in order to display an image.

The Y electrodes Y1-Yn and the X electrodes X1-Xn are disposed to cross the A electrodes A1-Am.

Discharge spaces at each crossing of the A electrodes A1~Am and the X and Y electrodes X1~Xn and Y1~Yn form discharge cells 110.

The PDP 100 is one example, and a panel with a different structure to which driving waveforms described herein can be applied can also be applicable.

The controller 200 receives an image signal for a frame and generates an A electrode driving control signal CONT1, an X electrode driving control signal CONT2, and a Y electrode driving control signal CONT3, and outputs the A electrode driving control signal CONT1, the X electrode driving control signal CONT2, and the Y electrode driving control signal CONT3 to the address, sustain, and scan electrode drivers 300, 400, and 500, respectively.

Furthermore, the controller 200 drives a frame by dividing it to a plurality of subfields each having a weight value.

The address electrode driver 300 receives the A electrode driving control signal CONT1 from the controller 200 and applies a driving voltage to the A electrodes A1-Am.

The sustain electrode driver 400 receives the X electrode driving control signal CONT2 from the controller 200 and applies a driving voltage to the X electrodes X1-Xn.

The scan electrode driver 500 receives the Y electrode driving control signal CONT3 from the controller 200 and applies a driving voltage to the Y electrodes Y1-Yn.

Figure 2:
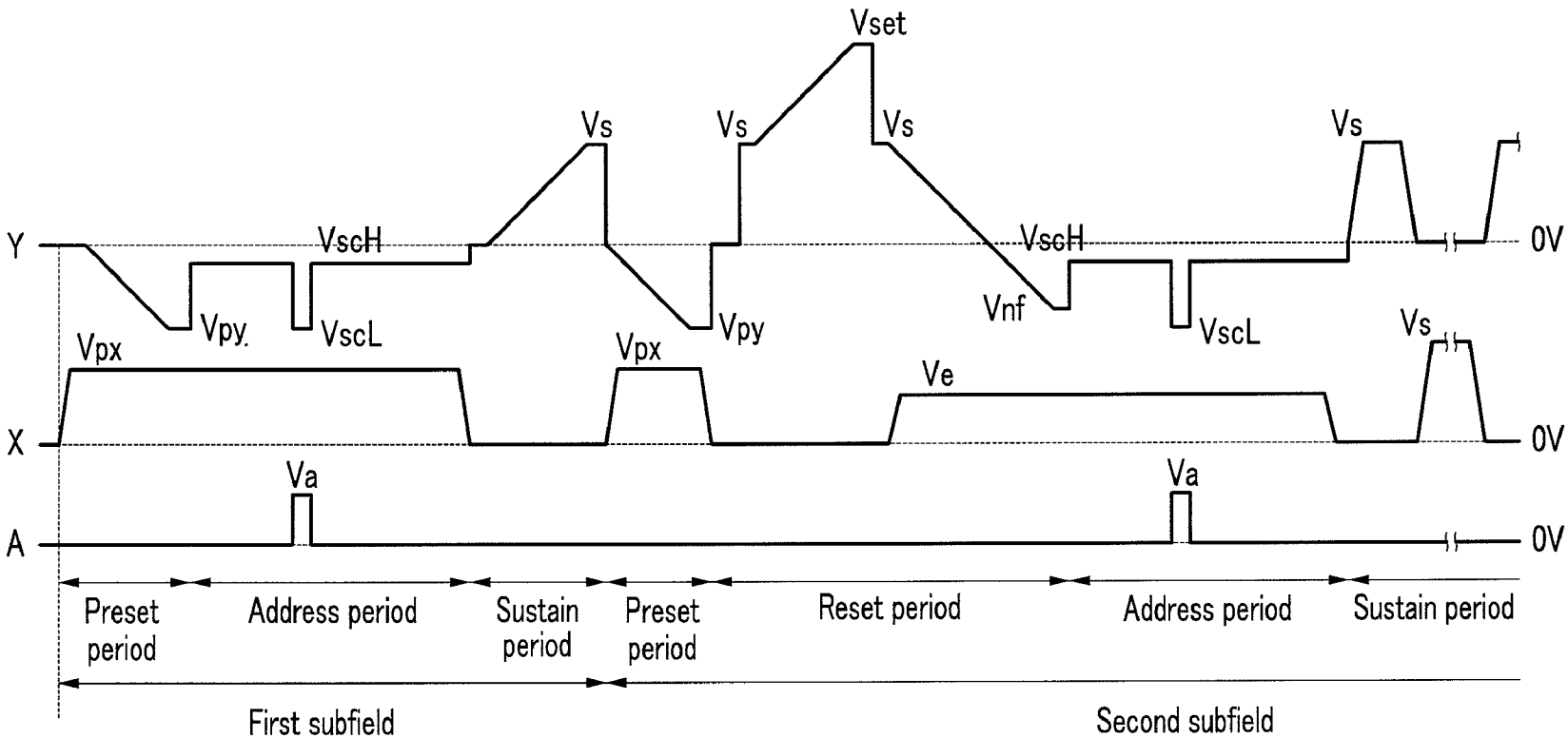
FIG. 2 is drawing illustrating a driving waveform of the plasma display device according to an exemplary embodiment.

FIG. 2 is drawing illustrating a driving waveform of the plasma display device according to an exemplary embodiment. FIG. 2 shows driving waveform applied to a Y electrode, an X electrode, and an A electrode forming one cell.

As shown in FIG. 2, a first subfield having minimum grayscales expressing unit light includes a preset period, an address period, and a sustain period.

In the preset period, the sustain electrode driver 400 applies a voltage Vpx to the X electrode, and the scan electrode driver 500 gradually decreases the voltage of the Y electrode from the reference voltage (0V in FIG. 2) to a voltage Vpy. Further, the address electrode driver 300 applies the reference voltage to the A electrode. Also, in the preset period, a difference between a voltage at the X electrode and a voltage at the Y electrode may satisfy Equation 1.

$$|Vpx-Vpy|>|Ve-Vnf| \quad \text{(Equation 1)}$$

In Equation 1, the voltage of Ve−Vnf may be a discharge firing voltage between the X electrode and the Y electrode so that the wall voltage between the Y electrode and the X electrode is near 0V. Thus, when the absolute value of a voltage of Vpx−Vpy is greater than the absolute value of a voltage of Ve−Vnf, a discharge is generated in the cells. As a result, positive (+) wall charges may be formed at the Y electrodes of the cells, and negative (−) wall charges may be formed at the X electrodes of the cells.

In the address period, in order to select a light emitting cell and a non-light emitting cell, the sustain electrode driver 400 maintains the voltage at the X electrode at the voltage Vpx, and the scan electrode driver 500 and the address electrode driver 300 apply a scan pulse having a voltage VscL and an address pulse having a voltage Va to the Y electrode and the A electrode, respectively. Further, the scan electrode driver 500 applies a voltage VscH that is higher than the voltage VscL to the Y electrodes to which the voltage VscL is not applied, and the address electrode driver 300 applies a reference voltage to the A electrodes to which the voltage Va is not applied.

During the address period, the scan electrode driver 500 and the address electrode driver 300 apply scan pulses to the Y electrode (Y1 in FIG. 1) of a first row and at the same time apply address pulses to the A electrodes positioned at light emitting cells in the first row.

Then, address discharges occur between the Y electrodes of the first row and the A electrodes to which the address pulses have been applied, forming positive (+) wall charges in the Y electrode and negative (−) wall charges in the A and X electrodes.

Subsequently, while applying scan pulses to the Y electrodes (Y2 in FIG. 1) of a second row, the scan electrode driver 500 and the address electrode driver 300 apply address pulses to the A electrodes of light emitting cells of the second row.

As a result, address discharges occur at cells having the A electrodes to which the address pulses have been applied and the Y electrodes of the second row, forming wall charges in the cells. Likewise, while the scan electrode driver 500 sequentially applies scan pulses to the Y electrodes of the remaining rows, the address electrode driver 300 applies address pulses to the selected A electrodes for light emitting cells to form wall charges therein.

If the voltage VscL is set to be lower than the voltage Vpy, the difference between the X electrode and the Y electrode in the address period is greater than the difference between the X electrode and the Y electrode in the preset period. As a result, the address discharge is effective.

In the sustain period, the sustain electrode driver 400 applies the reference voltage to the X electrode, and the scan electrode driver 500 gradually increases the voltage of the Y electrode from the reference voltage to the voltage Vs. A self erase discharge occurs between the Y electrode and X electrode when the voltage at the X electrode is changed from the voltage Vpx to the reference voltage. Consequently, a weak sustain discharge occurs between the X electrode and the Y electrode and between the Y electrode and the A electrode while the voltage of the Y electrode is gradually increased to the voltage Vs.

According to the exemplary embodiment, the unit light is expressed by the light generated by the discharge during the preset and address periods, and by the self erase discharge and the weak sustain discharge during the sustain period. Because the light generated in the preset period is very weak, the light generated in the preset period does not significantly affect the unit light.

In the first subfield, the wall voltage between the X electrode and the Y electrode after the preset period is denoted by Vwp, where Vwp may be expressed as Equation 2.

$$Vwp=Vpx-Vpy-Vfxy, \quad \text{(Equation 2)}$$

where Vfxy is the discharge firing voltage between the X electrode and the Y electrode. Since the Vwp is less than the discharge firing voltage Vfxy, the relationship of Equation 3 may be formed.

$$(Vpx-Vnf)/2<Vfxy \quad \text{(Equation 3)}$$

Further, the wall voltage between the X electrode and the Y electrode after the address period is denoted by Vwa, Vwa may be expressed as Equation 4.

$$Vwa=K(Vpx-VscL) \quad \text{(Equation 4)}$$

The relationship of Equation 5 results in the self erase discharge in the sustain period.

$$K(Vpx-VscL)\geqq Vfxy, \quad \text{(Equation 5)}$$

where K is a ratio of the applied voltage to the formed wall voltage, and generally, K has a value between 0.45 and 1. The relationship of Equation 6 may be formed from Equation 3 to 5, and Equation 6 may become the condition for causing the self erase discharge between the X electrode and the Y electrode in the sustain period.

$$(Vpx-Vpy)/2<Vfxy\leqq K(Vpx-VscL) \quad \text{(Equation 6)}$$

Further, K may be controlled by the width of the scan pulse. Thus, the unit light may be controlled by the width of the scan pulse.

Accordingly, when the width of the scan pulse in the address period of the first subfield is shorter than the width of the scan pulse in the address period of the second subfield, the unit light of the first subfield may be reduced.

A second subfield includes the preset period, a reset period, the address period, and the sustain period. That is, in the second subfield the preset period is just before the reset period in order to assure the discharge stability. The applied voltages to the X electrode, the Y electrode, and the A electrode in the preset period of the second subfield are the same as those of the first subfield.

In the reset period, the address electrode driver 300 and the sustain electrode driver 400 apply the reference voltage to the A and X electrodes, respectively, and the scan electrode driver 500 gradually increases the voltage at the Y electrodes from the voltage Vs to a voltage Vset. In FIG. 2, the voltage at the Y electrodes is shown to increase in a ramp pattern.

While the voltage at the Y electrodes increases, a weak discharge occurs between the Y and X electrodes and between the Y and A electrodes. As a result, negative (−) wall charges may be formed at the Y electrode and positive (+) wall charges may be formed at the X and A electrodes. The Vset voltage may be greater than a discharge firing voltage between the X electrode and the Y electrode in order to discharge all cells.

Further, since a discharge firing voltage between the X electrode and the Y electrode is greater than a discharge firing voltage between the A electrode and the Y electrode, when a discharge between the A electrode and the Y electrode is generated before a discharge between the X electrode and the Y electrode, a strong discharge could be generated during the reset period while the voltage of the Y electrode is gradually increased.

However, according to the exemplary embodiment, since positive (+) wall charges are formed at the Y electrode and negative (−) wall charges are formed at the X electrode in the preset period, the discharge between the Y electrode and the X electrode is generated earlier than the discharge between the Y electrode and the A electrode. Thus, a strong discharge in the reset period may be prevented.

Also during the reset period, the sustain electrode driver 400 applies a voltage Ve to the X electrodes and the scan electrode driver 500 gradually decreases the voltage of the Y electrodes from the voltage Vs to a voltage Vnf. In FIG. 2, the voltage of the Y electrodes is shown to decrease in a ramp pattern. Then, while the voltage of the Y electrodes is decreasing, a weak discharge occurs between the Y and X electrodes and between the Y and A electrodes, erasing the negative (−) wall charges formed in the Y electrodes and the positive (+) wall charges formed in the X and A electrodes.

Alternatively, in the reset period, the sustain electrode driver 400 may apply the voltage Vpx to the X electrode and the scan electrode driver 500 may gradually decrease the voltage of the Y electrodes from the voltage Vs to a voltage that is higher than the voltage Vnf while conforming to Equation 1.

Generally, the voltage Ve and the voltage Vnf may be set so that the wall voltage between the Y electrode and the X electrode is near 0V in order to prevent a misfiring discharge in a non-light emitting cell. That is, the voltage (Ve−Vnf) is set to be close to the discharge firing voltage between the Y electrode and the X electrode.

In the address period, in order to select a light emitting cell and a non-light emitting cell, the sustain electrode driver 400 maintains the voltage at the X electrode at the voltage Ve, and the scan electrode driver 500 and the address electrode driver 300 apply the scan pulse having the voltage VscL and the address pulse having the voltage Va to the Y electrode and the A electrode, respectively. Further, the scan electrode driver 500 applies the voltage VscH to the Y electrode to which the voltage VscL is not applied, and the address electrode driver 300 applies the reference voltage to the A electrode to which the voltage Va is not applied. Address discharge occurs between the Y electrode that is applied with the scan pulse and the A electrode that is applied with the address pulse as described above.

In the sustain period, the scan electrode driver 500 applies the sustain pulse alternately having a high level voltage (Vs in FIG. 2) and a low level voltage (0V in FIG. 2) to the Y electrodes a number of times corresponding to a weight value of the corresponding subfield. In addition, the sustain electrode driver 400 applies a sustain pulse to the X electrodes in a phase opposite to that of the sustain pulse applied to the Y electrodes. As shown in FIG. 2, the time/voltage profile of the sustain pulse applied during the sustain period of the first subfield is different than the time/voltage profile of the sustain pulses applied during the sustain period of the second subfield.

In this case, the voltage difference between the Y electrode and the X electrode is alternately a voltage Vs and a voltage −Vs. Therefore, in the light emitting cells, sustain discharge is repeatedly generated.

Alternatively, during the sustain period, a sustain pulse alternately having a Vs voltage and a −Vs voltage may be applied to one electrode among the Y electrode and the X electrode, and a voltage of 0V may be applied to the other electrode. In this case, since the voltage difference between the Y electrode and the X electrode also alternately has a Vs voltage and a −Vs voltage, the sustain discharge occurs at light emitting cells.

While this disclosure has been described in connection with certain exemplary embodiments, it is to be understood that the invention is not limited to the disclosed embodiments, but, on the contrary, is intended to cover various modifications and equivalent arrangements.

What is claimed is:

1. A method of driving a plasma display where each frame includes a plurality of subfields having luminance weight values, the plasma display including a first electrode and a second electrode extending in one direction, the method comprising:

decreasing a voltage at the second electrode from a second voltage to a third voltage while a first voltage is applied to the first electrode during a first portion of a first subfield, the first subfield having a minimum weight value as compared to the weight values of the other subfields;

applying a first scan pulse to the second electrode while the first voltage is applied to the first electrode during a first address period of the first subfield;

changing the voltage at the first electrode from the first voltage to a fourth voltage, the fourth voltage being less than the first voltage, and increasing the voltage at the second electrode from a fifth voltage to a sixth voltage while the fourth voltage is applied to the first electrode during a first sustain period of the first subfield;

increasing the voltage at the second electrode from an eighth voltage to a ninth voltage, the ninth voltage being greater than the sixth voltage while a seventh voltage is applied to the first electrode during a reset period of a second subfield; and decreasing the voltage at the second electrode from an eleventh voltage to a twelfth voltage while a tenth voltage is applied to the first electrode during the reset period, wherein a difference between the first voltage and the third voltage is greater than a difference between the tenth voltage and the twelfth voltage.

2. The method of claim 1, wherein the first voltage is higher than the tenth voltage.

3. The method of claim 1, wherein the third voltage is lower than the twelfth voltage.

4. The method of claim 1, further comprising applying a second scan pulse to the second electrode while the tenth voltage is applied to the first electrode during a second address period of the second subfield, wherein a width of the first scan pulse is shorter than a width of the second scan pulse.

5. The method of claim 1, further comprising gradually decreasing the voltage at the second electrode from the second voltage to the third voltage while the first voltage is applied to the first electrode during a second period during the second subfield before the reset period.

6. A plasma display, comprising:

a first electrode;

a second electrode extending in the same direction as the first electrode; and a driver, configured to:

decrease a voltage at the second electrode from a second voltage to a third voltage while a first voltage is applied to the first electrode during a first portion of a first subfield, the first subfield having a minimum weight value as compared to the weight values of the other subfields;

apply a first scan pulse to the second electrode while the first voltage is applied to the first electrode during a first address period of the first subfield;

change the voltage at the first electrode from the first voltage to a fourth voltage, the fourth voltage being less than the first voltage, and increase the voltage at the second electrode from a fifth voltage to a sixth voltage while the fourth voltage is applied to the first electrode during a first sustain period of the first subfield;

increase the voltage at the second electrode from an eighth voltage to a ninth voltage, the ninth voltage being greater than the sixth voltage while a seventh voltage is applied to the first electrode during a reset period of a second subfield; and decrease the voltage at the second electrode from an eleventh voltage to a twelfth voltage while a tenth voltage is applied to the first electrode during the reset period, wherein the difference between the first voltage and the third voltage is greater than the difference between the tenth voltage and the twelfth voltage.

7. The plasma display of claim 6, wherein the driver is further configured to decrease the voltage at the second electrode from the second voltage to the third voltage while the first voltage is applied to the first electrode during a second period before the reset period.

8. The plasma display of claim 6, wherein the first voltage is higher than the tenth voltage.

9. The plasma display of claim 6, wherein the third voltage is lower than the twelfth voltage.

* * * * *